United States Patent [19]

Scheinhütte

[11] Patent Number: 4,953,265

[45] Date of Patent: Sep. 4, 1990

[54] DEVICE FOR DETECTING NEPS IN CARDED, TEXTILE FIBER MATERIAL

[75] Inventor: Hans-Jürgen Scheinhütte, Schindellegi, Switzerland

[73] Assignee: Gebrüder Loepfe AG, Kempten, Switzerland

[21] Appl. No.: 317,299

[22] Filed: Mar. 1, 1989

[30] Foreign Application Priority Data

Mar. 2, 1988 [CH] Switzerland ..... 785/88

[51] Int. Cl.[5] ..... D01G 15/46

[52] U.S. Cl. ..... 19/297; 19/106 R

[58] Field of Search ..... 19/84, 105, 106 R, 204, 19/229, 297; 377/6

[56] References Cited

U.S. PATENT DOCUMENTS

| | | | |
|---|---|---|---|
| 3,157,915 | 11/1964 | Gilbo | 19/106 R |
| 3,235,911 | 2/1966 | Reiterer | 19/106 R |
| 3,562,866 | 2/1971 | Roberson et al. | 19/105 |
| 3,652,864 | 3/1972 | Person | 377/6 |
| 4,272,868 | 6/1981 | Grunder et al. | 19/106 R |
| 4,481,667 | 11/1984 | Price et al. | 377/6 |
| 4,805,266 | 2/1989 | Leifeld et al. | 19/105 |

FOREIGN PATENT DOCUMENTS

| | | |
|---|---|---|
| 002080 | 1/1981 | European Pat. Off. . |
| 162134 | 11/1984 | European Pat. Off. . |
| 189985 | 1/1986 | European Pat. Off. . |
| 860476 | 8/1986 | European Pat. Off. . |
| 486696 | 1/1967 | Switzerland . |
| 619045 | 12/1978 | Switzerland . |
| 627497 | 12/1978 | Switzerland . |
| 660920 | 12/1978 | Switzerland . |

*Primary Examiner*—Werner H. Schroeder
*Assistant Examiner*—Michael A. Neas
*Attorney, Agent, or Firm*—Harness, Dickey & Pierce

[57] ABSTRACT

For detecting neps in a textile fiber fleece band transported along a transporting path through a carding machine a detecting device comprises a mechanism for illuminating the fiber fleece band on at least one area located on the transporting path. Imaging optics project an image of this illuminated area onto the surface of one of a plurality of photo sensor elements. The area projected onto each one of the photo sensor elements substantially corresponds to the size of the neps to be detected. The photo sensor elements are connected to evaluation circuits for evaluating light intensity variations caused by neps passing the illuminated area.

8 Claims, 2 Drawing Sheets

DEVICE FOR DETECTING NEPS IN CARDED, TEXTILE FIBER MATERIAL

BACKGROUND OF THE INVENTION

1. FIELD OF THE INVENTION

The invention refers to a device for detecting neps or the like in a carded textile fiber fleece band.

Carded fiber fleece bands produced by carding machines inevitably contain a certain number of so-called neps and/or impurities. Neps are knots or accumulations of fibers of different sizes. The reasons are various for such neps in carded fiber fleece bands. They may be found in the characteristics of the raw material, in the operation of the breaker card or in the clothing of the carding cylinder. The control of the frequency of neps and impurities present in the fiber fleece therefore can be used as an indication for the proper operation of the carding machine and for the elimination of possible defects. Especially, the wear of the clothing of the carding cylinder and the proper time for resharpening or exchanging the clothing can be determined.

2. DESCRIPTION OF THE PRIOR ART

For determining the number of neps, it was common practice to remove a piece of the fiber fleece from the band from time to time in order to analyze this sample. For the analysis the band is stretched by means of a stretching device and illuminated from below. From the upper side the fleece is examined visually through a magnifying lens. The neps thereby can be visually detected and counted as dark points on the bright background of the translucent stretched fleece. This known method, however, has the disadvantage, that a sample of the fiber fleece has to be removed from the band for the mentioned analysis. Therefore, this analysis cannot be made continuously, but only in relatively long intervals and with a need for additional personnel. In the examination of the sample a certain estimation of the respective person is inevitable, so that the result of the analysis is not generally valid, but depends on the respective person.

SUMMARY OF THE INVENTION

Therefore it is an object of the invention to provide for a device for detecting and counting neps in a fiber fleece band without need of removing a sample from the fleece band and without need for additional personnel.

It is a further object of the invention to provide for a device for detecting neps or impurities in a fiber fleece band in a reproducible way and free of human estimation.

Again a further object of the invention is to provide for a detecting device for continuously controlling a textile fiber fleece band of a carding machine with respect to possible neps or impurities contained therein.

Still a further object of the invention is to provide for a detecting device by which a textile fiber fleece band of a carding machine can be controlled substantially over its whole width with respect to possible neps or the like contained therein.

Now, in order to implement these and still other objects of the invention, which will become more readily apparent as the description proceeds, the device for detecting nep in a textile fiber fleece band transported along a transporting path through a carding machine is manifested by the features that said device comprises an illuminating means for illuminating said fiber fleece band on at least one area located on said transporting path, said area having an extension transverse to the direction of the transporting path, an imaging optics for projecting an image of said illuminated area of said fiber fleece band on a defined image plane, a light sensing device located in said image plane for detecting the light intensities of said image and evaluation circuit means connected to said light sensing device for evaluating light intensity variations generated on said image by neps comprised in said transported fiber fleece band.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF A PREFERRED EMBODIMENT

The detecting device of the invention is based on the fact, that neps contain many more fibers per square millimeter than other parts of the textile fiber fleece. Neps are very small fiber accumulations with a typical diameter of about 0.5 mm and a typical length of about 1 mm. When the fiber fleece is illuminated in top illumination, the zones of the fleece containing neps will reflect more light than other parts of the fleece due to the much bigger fiber concentration at this location. In an image of such an illuminated area, each nep therefore appears as a bright spot. If such image is scanned by means of photo sensor elements, the neps can be detected as a change of brightness in the image. However, since textile fiber fleece bands do not have a homogeneous structure, there is a substantial background noise when detecting such changes of brightness. In order to eliminate this background noise due to statistical variations in the fiber concentration in the fleece, each photo sensor element has an active surface for scanning a portion of the image of the fiber fleece band, which in its dimensions substantially corresponds to the size of the neps. Since for such photo sensor elements each nep covers a substantial part of its dimensions, a substantial change in the light intensity is induced by each nep, which therefore can easily be discriminated against background noise. The most suitable dimension of the photo sensor elements depends on the image scale of the imaging optics, on one hand, and on considerations of cost, on the other hand. As will be explained later, dimensions of 1 mm $\times$2.5 mm for each photo sensor element have turned out to give useful results. Thereby, it is possible to use an arrangement of a plurality of individual elements or arrays of photo sensor elements or even completely integrated photo sensor cells.

Figure 1:
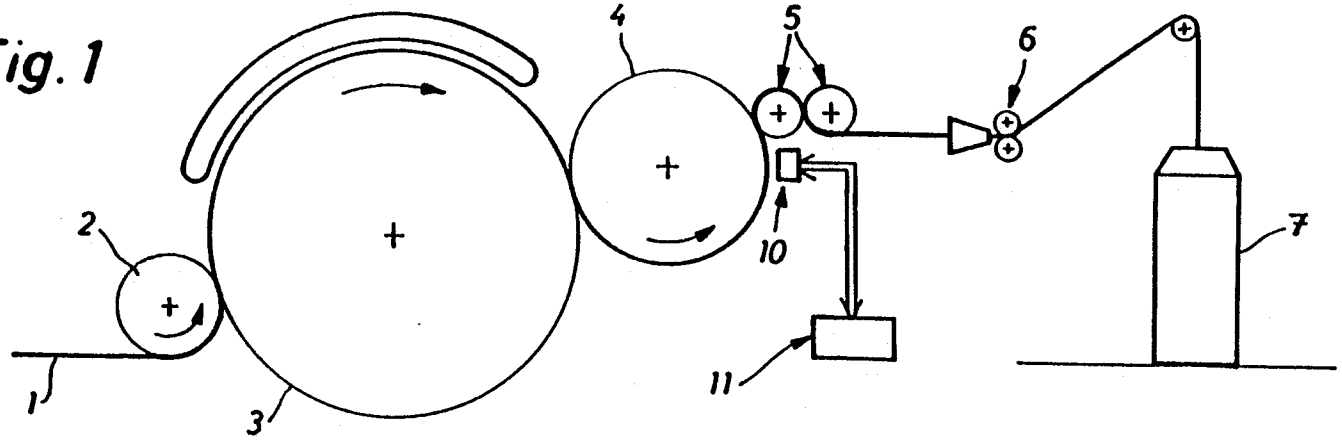
FIG. 1 is a schematical representation of a carding machine with the detecting device according to the invention.

Turning now to FIG. 1 a carding machine is generally shown having the device for detecting neps arranged at one of its rollers. A band of fiber web 1 is moved along a transporting path through the carding machine. First it passes through a licker-in roller 2 to a main drum 3 of the carding machine. The carded fiber web 1 then passes a doffer roller 4. Before the fiber web band 1 or fiber fleece band is taken off the doffer roller 4 by means of taking off rollers 5, the nep detection is carried out on the doffer roller 4. Therefore, the device 10 for detecting neps is placed at the doffer roller 4. In this stage of the procedure the fiber web or fleece band 1 is still in an extended state, so that possible neps can be seen from the surface of the web 1. After taking off the fleece from rollers 5, the fiber fleece passes calender rolls 6, by which it is reduced in its transverse dimensions and is stored in a can 7. The detecting device 10 is connected to a display and output circuit 11 arranged at the outside of the carding machine.

Figure 2:
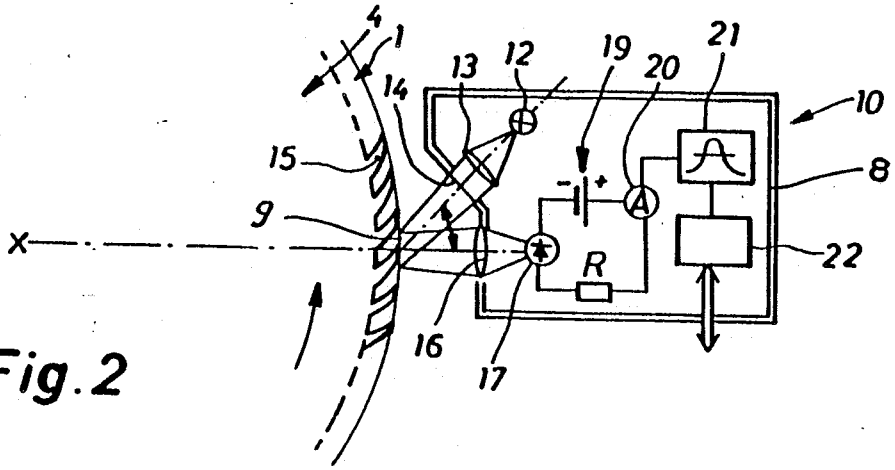
FIG. 2 shows details of the detecting device of the invention arranged adjacent to a doffer roller of a carding machine.

As already mentioned above, the detecting device 10 preferably is arranged adjacently to the doffer roller 4, as can be seen best from FIG. 2. The detecting device has a closed casing 8 extending substantially over the whole width of the roller 4 (see FIG. 3). In this casing 8 windows 14, 16 are provided for transmitting illuminating light to an illuminated area 9 and for projecting an image of the illuminated area 9 to photo sensor elements 17. These windows are preferably oriented in vertical direction or are forwardly inclined so that no dust deposition is formed on the windows.

In FIG. 2 a part of the doffer roller 4 is shown together with a more detailed representation of the detecting device 10. In this figure only one photo sensor element 17 is exhibited. However, it has to be understood that a plurality of such photo sensor elements 17 are comprised in the detecting device 10, as will be explained in connection with FIGS. 3 and 4. By means of a light source 12, which may be an electric bulb or an LED-element, the fiber fleece on the doffer roller 4 is illuminated via a condensor lens 13 and a slit 14 with a transparent window in the casing 8. The direction of the illuminating light beam has an angle of about 45° relative to the tangent at the doffer roller 4, whereas the direction of detection is about perpendicular to said tangent. Thereby, reflections of the illuminating light beam at the teeth 15 of the clothing of the doffer roller 4 can be avoided, which would affect the detection of the neps in the fiber web 1.

Figure 3:
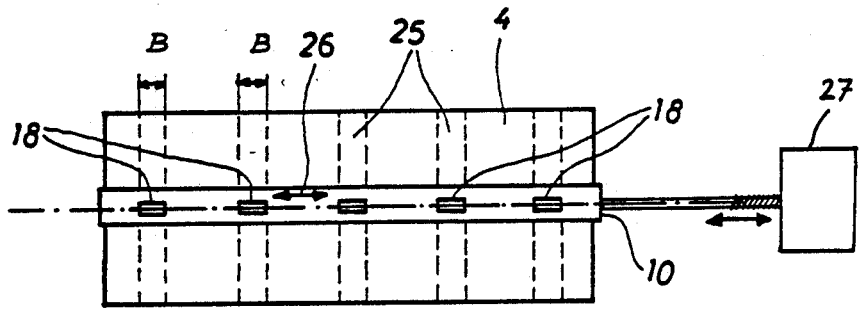
FIG. 3 is a plan view on a doffer roller of a carding machine with a detector device of the invention.
Figure 4:
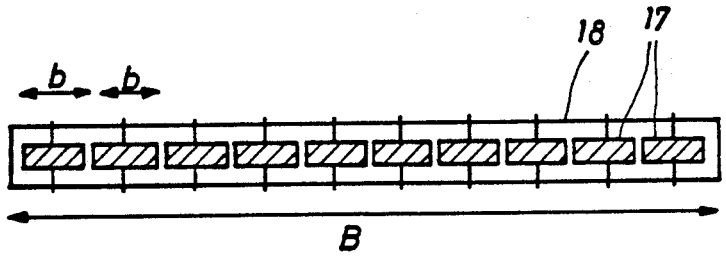
FIG. 4 is a representation of a line photo sensor used in the detecting device of the invention.

The illuminated area 9 on the web 1 is projected onto a photo sensor element 17 by means of an imaging optics 16. In FIG. 2 the photo sensor element 17 is shown only schematically as a circuit symbol. In practice it is preferred to use an integrated photo diode element having defined active surface dimensions. In the present embodiment of the invention the surface dimensions of the photo diode element are 1 mm in the transport direction of the fiber web 1 and 2.5 mm in transverse direction. However, this surface can be chosen smaller, as explained above. A plurality of such photo sensor elements 17 in arrays or in fully integrated structure are arranged in groups 18 (FIG. 3). Each group 18 can comprise ten sensor elements 17, each having a width b of 2.5 mm. One group 18 therefore covers a sector of a width of B =2.5 mm, which is scanned by this group 18 on the web 1 (see FIG. 3).

Each photo sensor element 17 is connected to an own evaluation circuit, as is schematically exhibited in FIG. 2. The photosensor element 17 is connected to a voltage source 19 and to a limiting resistance R. The level of the current A in this circuit then is a measure for the light received by the photo sensor element 17. The current A therefore is measured in a current measuring circuit 20 of known construction and the result of this measurement is transmitted to a discriminator circuit 21. If the measured level of the current exceeds a defined threshold, a signal is generated by the discriminator circuit 21. In a counter 22 the number of signals generated by each discriminator circuit 21 are summed up.

The evaluation of the detected light intensities can even be improved, if in the discriminator circuit 21 the derivative of the light intensity is used as a criterion, instead of the absolute intensities measured. By the movement of the web or fleece 1 relative to the photo sensor elements 17 each nep 1 appearing in a detected area generates an increase of the photo current in the respective photo sensor element 17 followed by a decrease. Therefore, eve the second derivative of the measured signals can be used as a criterion. To this end a differentiating circuit can be added to the circuit shown in FIG. 2.

If it should be avoided that in addition to neps also other impurities, as e.g. plant residues in the web or fleece are detected, then the counter 22 can be provided with an electronic time measuring circuit, by which the length of each detected signal can be determined. The counter 22 then can be operated to count only signals, which correspond to the typical small size of neps, thereby eliminating all signals of longer duration.

In the embodiment of FIG. 2 for each photo sensor element 17 an own evaluation circuit 17 is provided. Since all circuits are equal and since every photo sensor element has only two connections, it is preferred to combine the plurality of the evaluation circuits to an integrated circuit, which even may be integrated with the photo sensor elements.

However, instead of providing each photo sensor element 17 with an own evaluation circuit, in another embodiment of the invention a multiplex circuit is used, by means of which the signals of the photo sensor elements 17 are sequentially scanned. If the scanning frequency is in the range of Megahertz, as this is the case with known CCD-elements, a suitable time resolution of the signals for detecting neps is given. The multiplexed signal generated by sequentially scanning the photo sensor elements 17 then can be evaluated in a single evaluation circuit.

A further simplification of the detecting device 10 of the invention is achieved in that not the complete width of the web or fleece 1 is covered by photo sensor elements 17. Instead, as can be seen from FIG. 3, the detecting device 10 comprises several groups 18 of sensor elements 17, which groups are regularly distributed over the width of the web or fleece 1. Each group 18 comprises 10 individual sensors 17 (FIG. 4) and covers a sector of about 2.5 cm. Thereby, the quality of the carding process can be controlled over the whole width of the web or fleece 1 without however needing an excessive number of sensors 17. If the web 1 has to be controlled over its complete width in order to detect local deficiencies of the clothing of the carding cylinder 3, this can easily be achieved by slowly moving the detecting device 10 of FIG. 3 in transverse direction as indicated by arrow 26. To this end the detecting device 10 is displaceably mounted and driven by a linear drive 27. The count of the counter 22 then is correlated with the respective transverse position of the detecting device relative to the web or fleece 1, which allows a continuous control of the transported web 1 over its whole width.

Thereby, it is also possible to detect foreign bodies as e.g. pieces of wood pinched in the clothing of the doffer roller 4. With the above mentioned time measuring circuit signals can be detected which appear with a frequency corresponding to the rotating speed of the doffer roller 4. Such signals are an indication for a deficiency in the clothing in the respective sector detected. Therefore, such deficiencies can easily be detected and corrected in addition to the nep detection.

As explained above, the detection device of the invention preferably is combined with a carding machine and arranged at a place upstream of the calender rolls 6, i.e. in a zone of relatively low fiber density of the web 1. In this state of the web neps can be detected by projecting an illuminated area of the fiber web or fleece 1 onto the surface of a light sensor device. The light variations in the projected image caused by neps passing through the illuminated area then can easily be evaluated to detect neps. To this end it is preferred that the illuminated area of the web or fleece 1 projected onto the surface of each photo sensor element 17 has a size in the range of a nep, and e.g. does not exceed the size of a nep more than about ten times. Thereby, background noise can substantially be eliminated.

While there is shown and described a present preferred embodiment of the invention, it is to be distinctly understood that the invention is not limited thereto, but may be otherwise variously embodied and practiced within the scope of the following claims.

I claim:

1. A device for detecting neps in a textile fiber fleece band, said fiber fleece band being transported along a transporting path through a carding machine, said device comprising:

illuminating means arranged at a distance from said transporting path and having light emitting means for illuminating a defined area of said transporting path, said area having an extension transverse to the direction of the transporting path;

light sensing means arranged in a distance of said transporting path and having at least one imaging optics being provided for projecting an image of said illuminated area of said fiber fleece band on an image plane, and said light sensing means being arranged in said image plane; and at least one evaluation circuit connected to said light sensor, said evaluation circuit having a differentiating circuit for forming a first or second derivative of the sensor signal and circuit means for analyzing said differentiated signal.

2. A device of claim 1, wherein said evaluation circuit further comprises a time measuring circuit for measuring the length of each detected signal and for discriminating the detected signals in accordance with their time duration.

3. The device of claim 1, wherein said light sensing means comprises a line of photo sensor cells arranged adjacent to each other transverse to the direction of the transporting path of the fiber fleece band and in the image plane seems as though the photo cells are in the same plane as optics.

4. The device of claim 1, wherein said evaluation circuit comprises a timer circuit for measuring the duration of and/or the time interval between consecutive discriminated signals.

5. The device of claim 3, wherein said photo sensor cells are comprised in an integrated optical line detector, wherein electrical signals generated by the individual cells are read out sequentially and are evaluated in a single evaluation circuit.

6. A carding machine having a main drum for carding textile fibers and a doffer roller for taking off a carded textile fiber fleece band from said main drum, said carding machine having a device for detecting neps in said carded textile fiber fleece band transported through said carding machine, said device comprising:

illuminating means arranged at a distance from said transporting path and having light emitting means for illuminating a defined area of said transporting path, said area having an extension transverse to the direction of the transporting path;

light sensing means arranged at a distance from said transporting path and having at least one imaging optics and at least one light sensor, said imaging optics being provided for projecting an image of said illuminated area of said fiber fleece band on an image plane, and said light sensing means being arranged in said image plane; and at least one evaluation circuit connected to said light sensor, said evaluation circuit having a differentiating circuit for forming a first or second derivative of the sensor signal and circuit means for analyzing said differentiated signal.

7. The carding machine of claim 6, wherein said illuminated area of the surface of said doffer roller substantially extends over the width of said roller transverse to its transporting direction.

8. The carding machine of claim 6, wherein said illuminating means are arranged with respect to said surface of said doffer roller so that the light of said illuminating means has an angle of incidence of 45° relative to a tangent plane at the surface of said doffer roller.

* * * * *

UNITED STATES PATENT AND TRADEMARK OFFICE

CERTIFICATE OF CORRECTION

PATENT NO. : 4,953,265

DATED : September 4, 1990

INVENTOR(S) : Hans-Jürgen Scheinhütte

It is certified that error appears in the above-identified patent and that said Letters Patent is hereby corrected as shown below:

Col. 1, line 66, "hep" should be --neps--.

Col. 3, line 14, before "surface" delete new paragraph.

Col. 4, line 20, "eve" should be --even--.

Col. 6, lines 12-13, Claim 3, delete "seems as though the photo cells are in the same plane as optics".

Col. 6, line 14, Claim 4, "claim 1" should be --claim 2--.

Signed and Sealed this

Sixteenth Day of June, 1992

*Attest:*

*Attesting Officer*

DOUGLAS B. COMER

*Acting Commissioner of Patents and Trademarks*